US009756960B2

(12) United States Patent
Alegria

(10) Patent No.: US 9,756,960 B2
(45) Date of Patent: Sep. 12, 2017

(54) CHILD-SUPPORT DEVICE WITH SOOTHING DEVICE

(71) Applicant: KIDS II, INC., Atlanta, GA (US)

(72) Inventor: Adriana Alegria, Decatur, GA (US)

(73) Assignee: KIDS II, INC., Atlanta, GA (US)

( * ) Notice: Subject to any disclaimer, the term of this patent is extended or adjusted under 35 U.S.C. 154(b) by 717 days.

(21) Appl. No.: 14/022,294

(22) Filed: Sep. 10, 2013

(65) Prior Publication Data

US 2014/0068859 A1 Mar. 13, 2014

Related U.S. Application Data

(60) Provisional application No. 61/700,811, filed on Sep. 13, 2012.

(51) Int. Cl.

| | |
|---|---|
| ***A47D 1/00*** | (2006.01) |
| ***A47D 13/00*** | (2006.01) |
| ***A47D 15/00*** | (2006.01) |
| ***A47D 13/02*** | (2006.01) |
| ***A47D 13/10*** | (2006.01) |

(52) U.S. Cl.

CPC ..... *A47D 1/00* (2013.01); *A47D 13/02* (2013.01); *A47D 13/10* (2013.01); *A47D 15/006* (2013.01)

(58) Field of Classification Search

CPC ... A47D 1/00; A47D 7/00; A47D 9/00; A47D 11/00; A47D 11/005; A47D 11/007; A47D 13/00; A47D 13/02; A47D 13/06; A47D 13/063; A47D 15/00; A47D 15/005; A47D 15/006; A47D 15/008; A47C 31/11; A47C 31/10; A47C 7/62

USPC ..... 5/655, 652, 93.1, 424, 663, 658, 946, 5/482, 485; 297/219.12, 219.1, 188.01

See application file for complete search history.

(56) References Cited

U.S. PATENT DOCUMENTS

| | | | | |
|---|---|---|---|---|
| 4,590,633 A * | 5/1986 | Pickens | A47G 9/0207 446/369 |
| 4,754,512 A * | 7/1988 | Chao-Yang | A47D 15/003 446/226 |
| 4,914,765 A * | 4/1990 | Smith | A47G 9/1045 401/201 |
| 5,118,318 A * | 6/1992 | Lorizio | A47G 9/0253 5/639 |
| 5,546,620 A * | 8/1996 | Matthews | A47D 15/008 5/639 |

(Continued)

*Primary Examiner* — Robert G Santos

(74) *Attorney, Agent, or Firm* — Gardner Groff Greenwald & Villanueva, PC

(57) ABSTRACT

A child-support device includes a child-soothing device attached thereto in a position convenient for use and conveniently stored on the child-support device when not in use. The child-support device is for example a bouncer, rocker, swing, other motion device, high chair, car seat, carrier, stroller, bassinet, crib, or other device for supporting a child. And the child-soothing device is for example a blanket, pacifier, plush toy, other toy, or other device or object for soothing use by a child. In example embodiments, the child-soothing device is stored in a receptacle on a front lap-positioned junction member of a harness assembly of the child-support device and attached to the junction member, stored in a receptacle on a side-support portion of the child-support device and attached to the side-support portion, or attached to the junction member by a connector strap.

14 Claims, 3 Drawing Sheets

(56) References Cited

U.S. PATENT DOCUMENTS 5,897,164 A 4/1999 Kagan et al.
6,029,296 A * 2/2000 Terrell ..... A47D 13/08 5/485
6,038,720 A * 3/2000 Matthews ..... A47C 7/383 5/639
6,189,166 B1 2/2001 Braine et al.
6,233,763 B1 * 5/2001 Spaan ..... A47G 9/0207 446/72
6,561,588 B1 * 5/2003 Brady ..... B60N 2/28 297/188.01
6,684,422 B2 2/2004 LeFevre et al.
7,156,458 B2 * 1/2007 Hanberg ..... A47D 15/006 297/219.1
7,578,746 B1 * 8/2009 Johnson ..... A63H 33/006 297/485
7,694,364 B1 * 4/2010 Toma ..... A63H 33/006 446/227
8,070,225 B2 * 12/2011 Machabee ..... B60N 2/26 297/188.01
8,312,575 B1 * 11/2012 Maraj ..... A47D 9/00 5/663
8,919,871 B2 * 12/2014 Huntsberger ..... A47D 1/02 297/184.13
2005/0264056 A1 * 12/2005 Hanberg ..... A47D 15/006 297/219.12
2006/0049674 A1 * 3/2006 Fair ..... B60N 2/60 297/188.2
2008/0012406 A1 1/2008 Piwko, Jr. et al.
2008/0252115 A1 * 10/2008 Machabee ..... B60N 2/26 297/217.1
2009/0199337 A1 8/2009 Long
2013/0113240 A1 * 5/2013 Huntsberger ..... A47D 1/02 297/188.01
2014/0068859 A1 * 3/2014 Alegria ..... A47D 1/00 5/424

* cited by examiner

FIG. 1
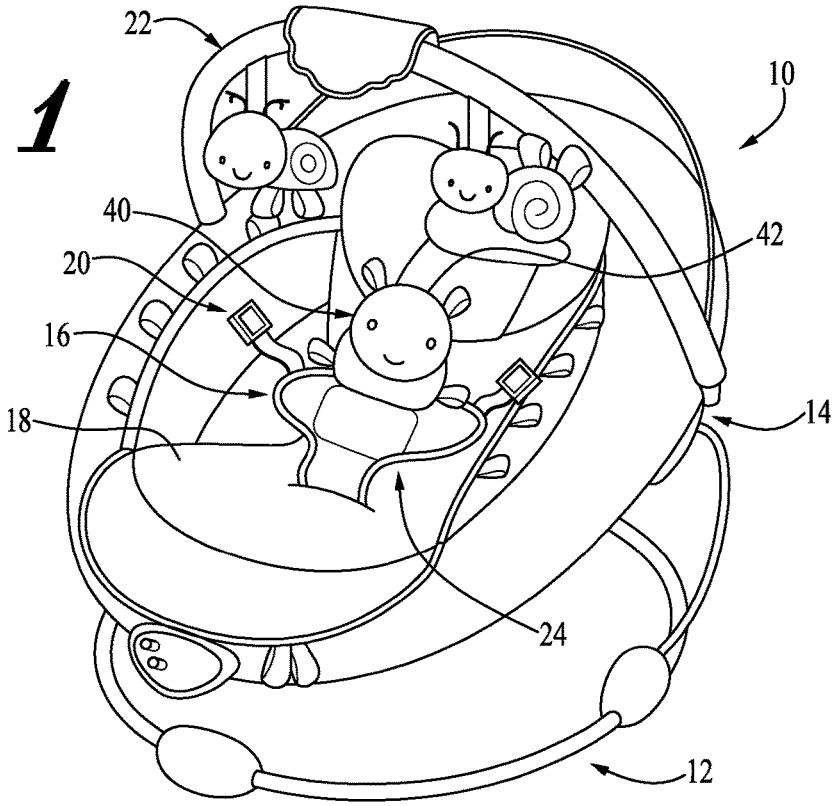
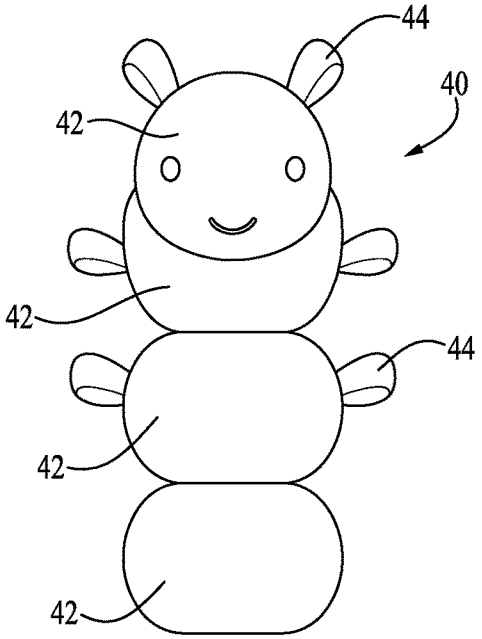
FIG. 2
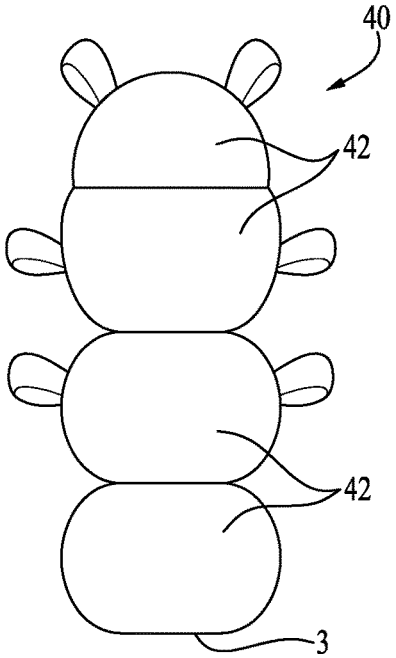
FIG. 3

CHILD-SUPPORT DEVICE WITH SOOTHING DEVICE

CROSS-REFERENCE TO RELATED APPLICATION

This application claims the benefit of U.S. Provisional Patent Application Ser. No. 61/700,811 filed Sep. 13, 2012, the entirety of which is hereby incorporated by reference herein.

TECHNICAL FIELD

The present invention relates generally to the field of devices for supporting children, and more particularly to attachment and storage of a soothing device for use by a child in a child-support device.

BACKGROUND

The field of child-support devices generally includes bouncers, rockers, swings, other motion devices, high chairs, car seats, carriers, strollers, bassinets, cribs, and the like. Commonly, such child-support devices include a support surface (e.g., a seat) for supporting the child in a sitting, reclining, lying, or standing position, and sometimes a harness for securing the child safely in place on the support surface. To comfort the child in the child-support device, caregivers often provide the child with a soothing device. The field of child-soothing devices generally includes blankets, pacifiers, plush toys, other toys, and the like, for soothing use by the child in the child-support device by providing comfort, amusement, education, entertainment, or just general interest and engagement.

An issue with such child-soothing devices is conveniently positioning them for use and conveniently storing them when not in use. Some child-support devices include a toy bar spaced apart from the seat (or other support surface) and to which one or more child-soothing devices are mounted (e.g., in suspension) to position them in front of the child at hand-to-eye level for visual, audible, and/or tactile engagement. But this requires the use of a bar extending across the seat, which can be an obstruction. In addition, sometimes caregivers simply provide the child in the seat with a child-soothing device that is unattached to any mounting structure (e.g., it's stored in a separate baby tote bag). But this frequently results in the child dropping the child-soothing device onto the ground where it becomes dirty, otherwise unsanitary, or lost.

Accordingly, it can be seen that needs exist for improved positioning and storage of child-soothing devices for use by children in child-support devices. It is to the provision of solutions meeting these and other needs that the present invention is primarily directed.

SUMMARY

The present invention relates to a child-support device that includes a child-soothing device attached thereto in a position convenient for use and conveniently stored on the child-support device when not in use. The child-support device is for example a bouncer, rocker, swing, other motion device, high chair, car seat, carrier, stroller, bassinet, crib, or other device for supporting the child in a sitting, reclining, lying, or standing position. And the child-soothing device is for example a blanket, pacifier, plush toy, other toy, or other device or object for soothing use by a child in the child-support device by providing comfort, amusement, education, entertainment, or just general interest and engagement.

In example embodiments, the child-soothing device is stored in a receptacle on a front lap-positioned junction member of a harness assembly of the child-support device and attached to the junction member, stored in a receptacle on a side-support portion of the child-support device and attached to the side-support portion, or attached to the junction member by a connector strap. In other embodiments, the child-soothing device is attached to other parts of the child-support device and/or stored in other locations and/or by other retainer structures on the child-support device.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWINGS

FIG. 1 is a side perspective view of a child-support device according to a first example embodiment of the present invention, showing a child-soothing device in a storage position.

FIG. 2 is a front view of the child-soothing device of FIG. 1.

FIG. 3 is a rear view of the child-soothing device of FIG. 2.

DETAILED DESCRIPTION OF EXAMPLE EMBODIMENTS

Figure 4:
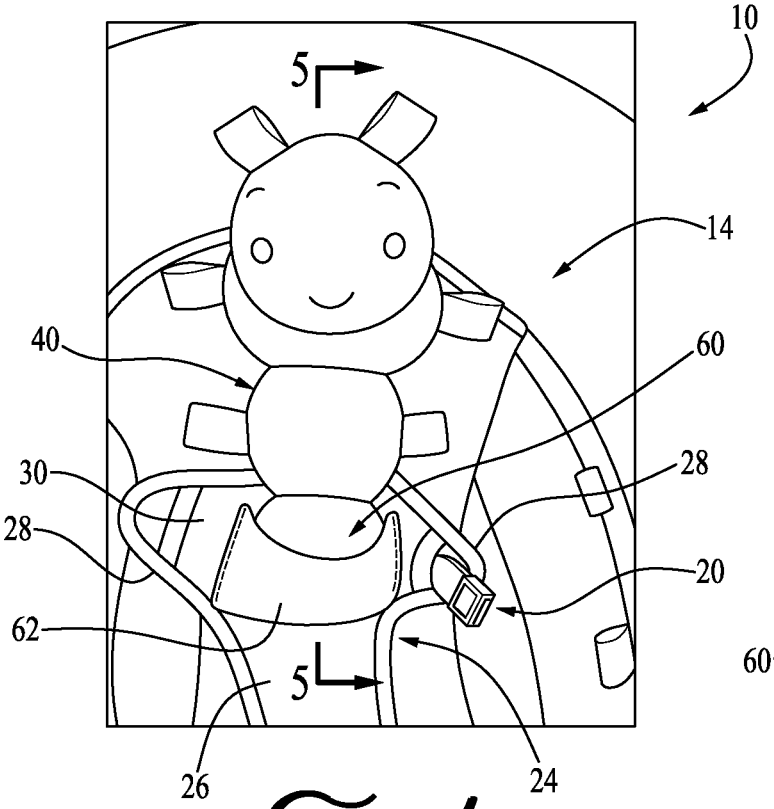
FIG. 4 is a detail front perspective view of a portion of the child-support device of FIG. 1, showing the child-soothing device in a use position.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-5 show a child-support device 10 including a child-soothing device 40 according to a first example embodiment of the present invention. Referring particularly to FIG. 1, the child-support device 10 includes a frame 12, a child receptacle 14 mounted to the frame, and a harness assembly 16 coupled to the child receptacle. The frame 12 is configured to be supported by a frame-support surface (e.g., resting on a floor or suspended from a door jamb), the child receptacle 14 includes a support surface 18 configured to receive and support a child, and the harness 16 is configured to secure the child safely in place on the support surface. In addition, in some embodiments the child-support device 10 includes a toy bar 22 (for example, as depicted), a carrying handle, and/or a release mechanism for decoupling the child receptacle 14 from the frame 12.

In the depicted embodiment, the child-support device 10 is a bouncer. For the depicted bouncer 10, the frame 12 includes a peripheral base member configured to rest on a floor and a spring arm extending from the base to the child receptacle 14 to produce an oscillating, bouncing effect to the child receptacle when an activating force is applied to it. The child receptacle 14 includes a seat and a removable liner on the seat that defines the child-support surface 18. And the harness assembly 16 includes one or more straps 20 that are releasably coupled to the child receptacle 14 and configured to strap the child into the child receptacle 14. In addition, the bouncer 10 includes a toy bar 22 extending across the child receptacle 14 for carrying the bouncer.

In other embodiments, the child-support device is a rocker, swing, other motion device, high chair, car seat, carrier, stroller, bassinet, crib, or other device for supporting the child in a sitting, reclining, lying, or standing position. In such other embodiments, the frame typically includes rocker arms (for a rocker), suspension straps or arms (for a swing), legs (for a high chair), a detachable base (for a car seat), wheels on legs (for a stroller), or side rails (for a bassinet or crib). In still other embodiments, the child receptacle includes a seat that itself defines the child-support surface (a separate removable liner or seat sling is not provided), or a generally flat child-support surface (for a bassinet or crib).

Referring now particularly to FIGS. 2-3, in the depicted embodiment the child-soothing device 40 includes a blanket. The depicted blanket includes a series of segments of material (e.g., cotton fabric) 42 attached together (e.g., sewn) to form an elongated sheet having the appearance (e.g., shape, proportions, and embellishments) of a caterpillar-like character. The blanket 40 is made of a soft material (e.g., plush cotton), and is sized for grasping by the child (not for covering the child for warmth), to provide a soothing effect to the child. Embellishments (strips or loops 44 suggestive of feet or ears/antennae) can be provided to enhance the caterpillar-like appearance. And for blankets 40 designed to have the appearance of an animal (such as that depicted), one of the segments 42 can have the appearance of the animal's head, include representative facial features (e.g., eyes and a nose embellishments), and overlap with the adjacent segment.

In other embodiments, the child-soothing device includes a blanket in another size and/or shape. For example, the blanket can have the appearance of another animal, character, or object, it can be shaped as a traditional square or rectangular blanket formed from a single cut of material, and/or it can be sized to cover the child to provide warmth. And in still other embodiments, the child-soothing device is a pacifier, plush toy, other toy, or other device or object for soothing use by a child in a child-support device by providing comfort, amusement, education, entertainment, or just general interest and engagement (mental and/or physical).

Figure 5:
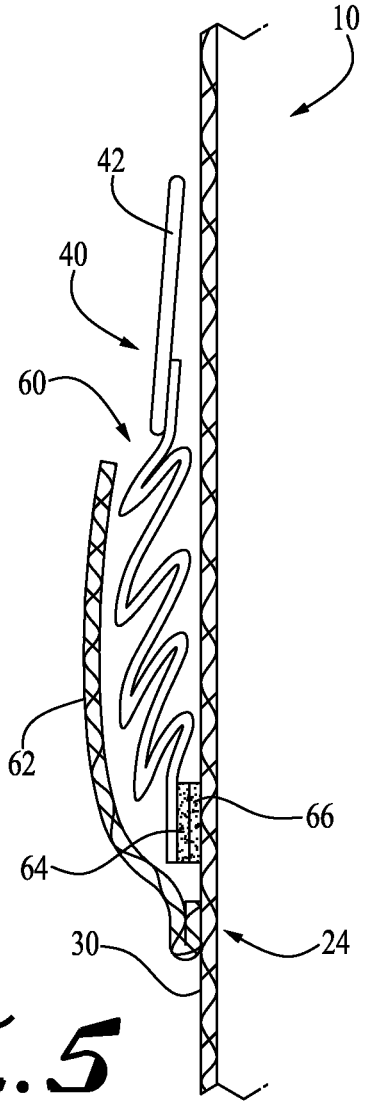
FIG. 5 is a detail side view, in partial cross section at line 5-5, of a portion of the child-support device of FIG. 4 with the child-soothing device in the storage position.

Referring now particularly to FIGS. 4-5, attachment and storage features are provided by which the child-soothing device 40 is attached to the child-support device 10, such that in a use position, the child-soothing device is conveniently located for use by the child in the child receptacle 14, and in a stored position, the child-soothing device is conveniently stored on the child receptacle when not in use by the child. Typically but not necessarily, the child-soothing device 40 in the stored position is located on the child-support device 10 where the child occupant (in the age range the child-support device is designed for) can see and easily reach it, such that the child can grasp the child-soothing device in the stored position and move it to the use position (and preferably move it back). As such, the child-support device can be designed with the child-soothing device attached to and stored on a side-support (of the child receptacle seat), a junction member (of the harness assembly), or elsewhere on it.

In the depicted embodiment, for example, a receptacle 60 is positioned on a junction member 24 of the harness assembly 16. As discussed above, the harness 16 is configured to releasably restrain a child positioned in the child receptacle 14, and includes one or more straps 20 that include releasable buckles and that are positionable across/over the lap and/or shoulders of the child occupant for such purpose. In addition, the harness 16 includes the junction member 24, which is positioned in the front centrally between the legs and across the lap of the child occupant, and to which the straps 20 are attached (e.g., two lap or shoulder straps can be connected to the junction member or one can extend through a sleeve in it). In the depicted embodiment, the junction member 24 is T-shaped with three legs to provide three attachment locations. That is, the center leg 26 is positioned between the occupant child's legs (e.g., for direct attachment to the child-support device 10), the two lateral legs 28 are positioned across/over the lap or shoulders of the child occupant (e.g., for releasable attachment to the child-support device via the straps 20), and the term T-shaped is intended to include functional equivalents, specifically Y-shaped and inverted-delta-shaped. In alternative embodiments, the junction member has another shape (e.g., circular, polygonal, or another regular or irregular shape) while still providing the three attachment locations. In the depicted embodiment, the junction member 24 is made of a soft material (e.g., plush cotton) with padding for comfort so it doesn't dig into the child occupant while the straps 20 are tightened, though alternatively, other materials such as plastic can be used.

The receptacle 60 is sized and shaped to receive at least a substantial, usable portion of the child-soothing device 40 such that the child-soothing device is stored, that is, restrained from flopping about freely and hitting the child in the face or hands. For example, in FIG. 1 the blanket 40 is in a storage position contained within the soother receptacle 60, except for the head segment 42 (and a portion of the adjacent segment), which can remain exposed for grasping (by the child or a caregiver) to easily remove the blanket (i.e., at least a substantial, usable portion thereof) from the receptacle and for soothing (and decorative) effect. If desired, the entirety of the blanket 40 or other child-soothing device can be positioned within the soother receptacle 60 in the storage position. And to reposition the blanket 40 to a use position shown in FIG. 4, it (i.e., at least a substantial, usable portion of the blanket) can be pulled out of the soother receptacle 60 by the child occupant or a caregiver for soothing use.

As such, in typical embodiments for storing the blanket 40, the soother receptacle 60 is about 3.5 inches to about 4.5 inches (4.0 inches in the depicted embodiment) by about 3.25 inches to about 4.25 inches (3.75 inches in the depicted embodiment) in size (with the thickness generally negligible, but typically about 0.4 mm to about 0.6 mm (0.5 mm in the depicted embodiment) when empty, and variable depending for example on the flexible resiliency of the sheet of material 62 used (see below) and how much the length and width are reduced when the receptacle is stuffed more and more into the receptacle). These example generally rectangular size ranges are representative and not limiting of the invention. Rather, these example rectangular size ranges are typical for use with the depicted generally rectangular blanket 40. In typical embodiments, for example, the blanket 40 is about 4.0 inches to about 5.0 inches (4.5 inches in the depicted embodiment) by about 10.0 inches to about 12.0 inches (11.0 inches in the depicted embodiment) in size when unfolded (with the thickness generally negligible but typically about 0.2 inches to about 0.3 inches; 0.25 inches in the depicted embodiment).

Typically, the soother receptacle 60 is positioned on a front-facing surface 30 of the junction member 24 for conveniently accessing the child-soothing device 40 by the child occupant or caregiver, as depicted. Alternatively, the soother receptacle can be positioned on an opposite, rear-facing surface of the junction member or at another location on the child receptacle 14. In addition, the soother receptacle 60 is typically in the form of a pocket that is formed by and between the surface 30 of the junction member 24 and a sheet of material 62 attached (e.g., sewn) thereto (as depicted), or that is formed by an interior or exterior pouch attached (e.g., sewn) to the junction member 24. The sheet 62 is typically made of a soft material (e.g., plush cotton) and can additionally or alternatively include a conventional stretch material with a flexible resiliency. Typically, the soother receptacle 60 includes an open top and a closed bottom and sides for top insertion of the child-soothing device 40, as depicted. Alternatively, the soother receptacle can include an open side for side insertion of the child-soothing device. And in some embodiments, a cover flap and/or closure (e.g., button(s), snap(s), or zipper) can be provided for the receptacle to help retain the child-soothing device therein.

The child-soothing device 40 is attached to the child-support device 10 so that the child-soothing device does not fall from the child occupant's grasp and control during use. The attachment location is typically within the receptacle 60 (e.g., at the bottom thereof, as depicted) on the junction member 24, or immediately adjacent the receptacle. Alternatively, the attachment location can be elsewhere on the junction member or elsewhere on the child-support device (not on the junction member).

The attachment can be removable or permanent. Removable attachment means that the caregiver can easily detach the child-soothing device 40 for cleaning, replacing, and/or independent use. For example, in the depicted embodiment the removable attachment is provided by mating hook-and-loop fasteners 64 and 66 positioned at a mounting portion (e.g., end) of the child-soothing device 40 and within the receptacle 60 (e.g., to the surface 30 and/or the pocket sheet 62). In other embodiments, the removable attachment includes a tie(s), snap(s), button(s), zipper, or other conventional non-permanent attachment device. And in still other embodiments, the removable attachment includes a loop (e.g., a plastic ring or a loop of material) permanently attached to the child-support device and a clip fastener permanently attached to the child-soothing device. Permanent attachment means that the caregiver cannot easily detach the child-soothing device 40 for cleaning or replacing; that is, it might be possible to separate the child-soothing device from the child-support device 10 but doing so would tend to require a tool to provide mechanical advantage and/or would tend to result in a failure of the child-soothing device such that it could not thereafter be used for its intended purpose, provided that, in some embodiments, the entire seat sling (cloth portion of the seat), including the blanket, can be detached from the seat frame and washed or cleaned. For example, permanent attachments include sewing and gluing.

In use, a child is placed into the child-support device 10 and secured in place by the harness assembly 16. With the child-soothing device 40 stored in the soother receptacle 60 on the junction member 24, the soothing device is positioned within easy reach of and sight by the child, so the child can easily withdraw the child-soothing device 40 from the soother receptacle 60 for soothing use by the child, or a caregiver can do so. And when finished or otherwise desired, the child or caregiver can return the child-soothing device 40 to the soother receptacle 60 for storage.

With the child-soothing device 40 attached to the child-support device 10, if the child loses grip, then the soothing device will not fall to the ground and become unsanitary, and instead it will only fall to a location still within the reach of the child for continued use. In addition, in embodiments in which the child-soothing device 40 is removably attached to the child-support device 10, the caregiver can detach the soothing device, and then clean and replace it, permit the child to use it independently of (e.g., remotely from) the child-support device, or substitute in one or more of the same or other soothing devices for storage in the soother receptacle 60 (in some embodiments the receptacle is sized and shaped large enough to store multiple of the soothing devices of the same or different types, and in others the support device can include multiple receptacles, each for receiving one or more soothing devices).

Figure 6:
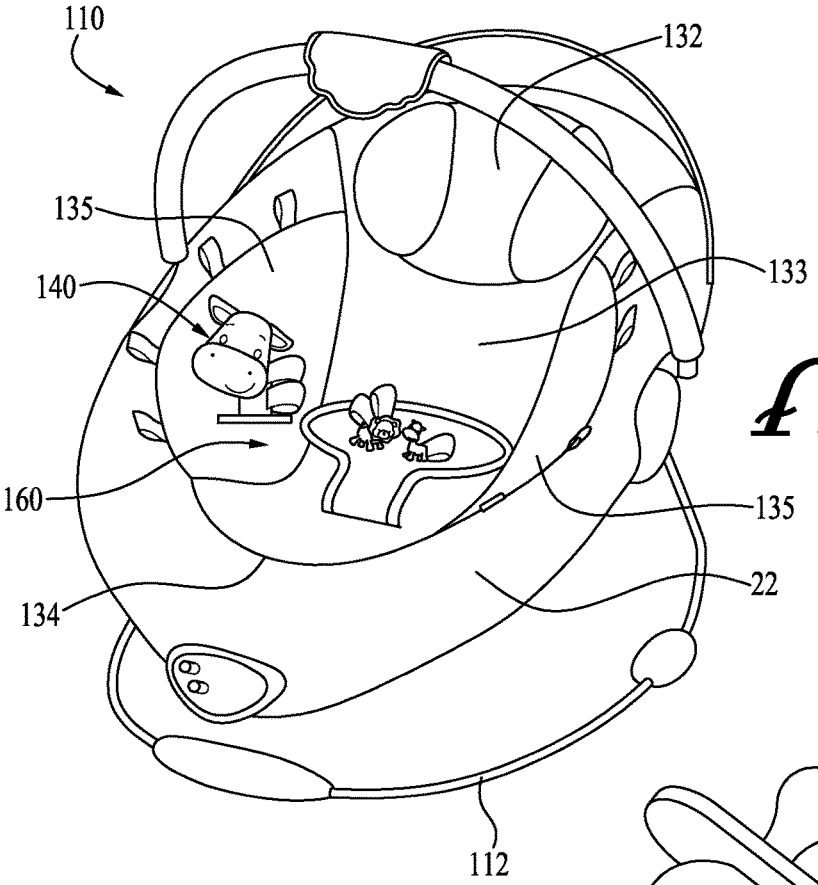
FIG. 6 is a side perspective view of a child-support device according to a second example embodiment of the present invention, showing a child-soothing device in a storage position.

Referring now to FIG. 6, there is shown a child-support device 110 according to a second example embodiment of the present invention. The child-support device 110 of this embodiment is substantially similar to that of the first embodiment, with a few exceptions of note.

In this embodiment, the child-soothing device 140 is positioned at a different location on the child-support device 110. Again, the child-support device 110 depicted in the drawings figure is a bouncer that includes a frame 112, a child receptacle 134, and a harness assembly 116, with the child receptacle including a head-support portion 132, a torso-support portion 133, a leg-support portion 134, and opposing side-support portions 135. The child-soothing device 140 is a plush toy (e.g., having the appearance of a giraffe, as depicted) that is attached (e.g., removably or permanently) to one of the side support portions 135 and storable in a receptacle 160 on that same side support portion. The structural elements of the attachment and the receptacle can be of the same or another type as described above with respect to the first embodiment.

Figure 7:
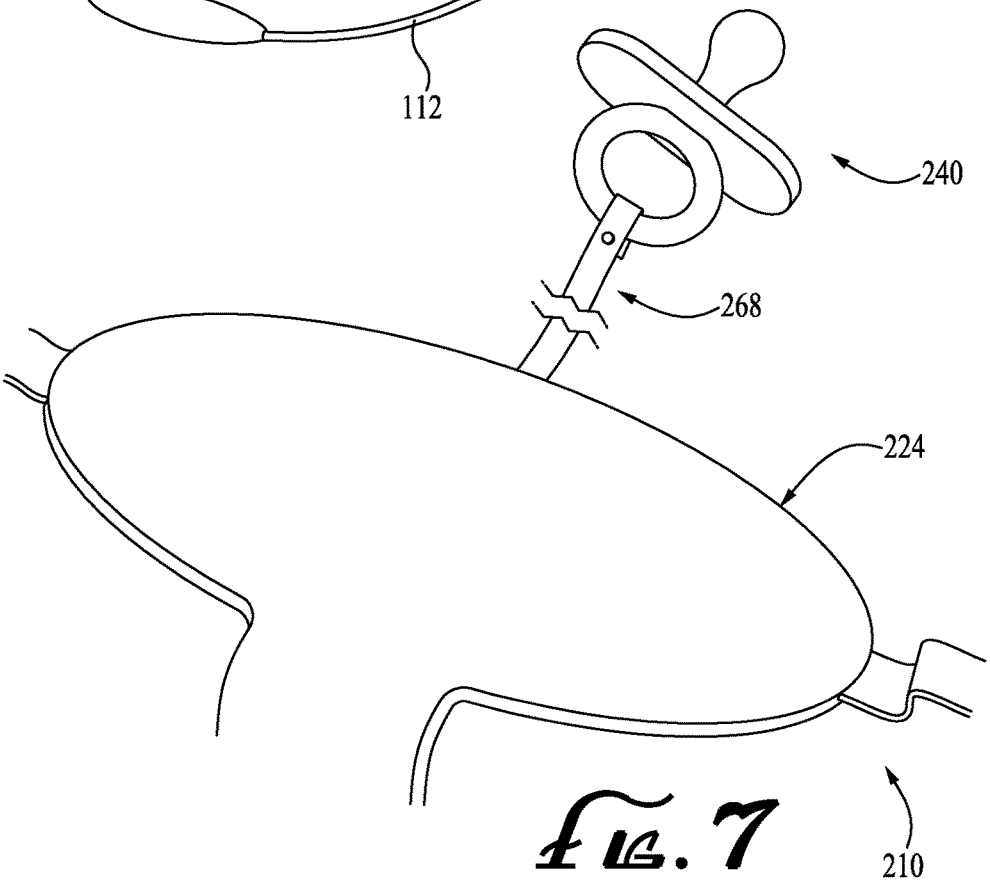
FIG. 7 is a detail perspective view of a portion of a child-support device according to a third example embodiment of the present invention.

Referring now to FIG. 7, there is shown a portion of a child-support device 210 according to a third example embodiment of the present invention. The child-support device 210 of this embodiment is substantially similar to that of the first embodiment, with a few exceptions of note.

In this embodiment, the child-soothing device 240 is attached to the junction member 224 of the child-support device 110 in a different manner. The child-soothing device 240 is a pacifier that is attached to the junction member 224 by a connector strap 268. For example, the connector strap 268 can be permanently attached (e.g., sewn or glued) to an upper edge of the junction member 224 and removably attached (e.g., by a snap or button) to a ring of the pacifier 240, as depicted. Alternatively, both ends of the connector strap can include the same or other conventional removable or permanent attachments (e.g., as described above). The connector strap 268 can be made of a resiliently flexible material for stretching in use, if desired, or made of a non-stretch material. In the depicted embodiment, a soother receptacle is not included for storing the child-soothing device. In other embodiments, a soother receptacle or other retainer (e.g., a hook, clip, loop, hook-and-loop fasteners) is provided on the junction member or another part of the child-support device (e.g., on the head-support portion), though in such designs the child-soothing device might not be within the sight and reach of the child occupant such that the caregiver must access it for the child because the child can't do so for itself.

Thus, in some embodiments the child-support device includes an attachment feature for the child-soothing device but not a storage feature. In some such embodiments, for example, the child-soothing device is attached to the child-support device without being stored in the soother receptacle or other storage structure. In other embodiments, the child-support device includes a storage feature for the child-soothing device but not an attachment feature. In some such embodiments, for example, the child-soothing device is stored in the soother receptacle or another storage structure without being attached to the child-support device.

While the invention has been described with reference to preferred and example embodiments, it will be understood by those skilled in the art that a variety of modifications, additions and deletions are within the scope of the invention, as defined by the following claims.

What is claimed is:

1. A device for supporting a child, comprising:

a child receptacle adapted to receive the child;

a harness assembly adapted to secure the child in the child receptacle, wherein the harness assembly includes a front junction member and one or more straps, wherein the junction member is T-shaped and includes three legs configured to be positioned centrally between the child's legs and across the child's lap with the one or more harness straps attached to one or more of the T-shaped junction member legs, and wherein the junction member includes a front-facing surface;

a child-soothing device for soothing use by the child in the child receptacle; and a retainer mounted to the child receptacle and the child-soothing device to retain the child-soothing device on the child receptacle, wherein the retainer is positioned on the front-facing surface of the T-shaped junction member such that the child-soothing device is attached to and stored on the T-shaped junction member, and wherein the retainer includes a decouplable attachment adapted to permit the child-soothing device to be detached from the child-support device for cleaning;

wherein the child-soothing device is engaged by the retainer on the child receptacle such that, in a use position, the child-soothing device is conveniently located for use by the child in the child receptacle, in a stored position, the child-soothing device is attached to the child receptacle by the retainer and conveniently stored by the retainer on the child receptacle when not in use by the child, and in the use position, the child-soothing device is displaced from the stored position and the child-soothing device remains attached to the child receptacle by the retainer.

2. The child-support device of claim 1, wherein the child-soothing device is attached to and stored on the child receptacle in the stored position such that the child can see and reach the child-soothing device and thereby such that the child can grasp the child-soothing device in the stored position and move the child-soothing device to the use position.

3. The child-support device of claim 1, wherein the removable attachment includes mating hook-and-loop fasteners on the child-soothing device and the child-support device.

4. The child-support device of claim 1, wherein the retainer includes a soother receptacle on the child-support device that receives and stores at least a substantial portion of the child-soothing device in the stored position, wherein in the use position at least a substantial portion of the child-soothing device is not received within the soother receptacle.

5. The child-support device of claim 4, wherein the soother receptacle includes a pocket formed by a sheet of material attached to a surface of the child-support device.

6. The child-support device of claim 5, wherein the pocket includes an open top and a closed bottom and sides to provide for top insertion of the child-soothing device into the pocket.

7. The child-support device of claim 4, wherein the child-soothing device is attached to the child-support device by a connector strap at a location within the soother receptacle.

8. The child-support device of claim 1, wherein the child-support device is a bouncer that includes a frame adapted to rest on a supporting surface and that is coupled to and supports the child receptacle.

9. The child-support device of claim 1, wherein the child-soothing device is a blanket.

10. The child-support device of claim 1, further comprising a connector strap attached to the child-soothing device and attached to the child-support device.

11. A device for supporting a child, comprising:

a child receptacle adapted to receive the child;

a harness assembly adapted to secure the child in the child receptacle, wherein the harness assembly includes a front T-shaped junction member with three legs and one or more straps attached to one or more of the junction-member legs, with the T-shaped junction member configured to be positioned centrally between the child's legs and across the child's lap;

a child-soothing device for soothing use by the child in the child receptacle;

a soother receptacle positioned on a front-facing surface of the T-shaped junction member, wherein the soother receptacle includes a pocket formed in the front-facing surface of the T-shaped junction member, wherein the soother receptacle pocket receives the child-soothing device in a stored position; and a retainer mounted to the child receptacle and the child-soothing device to retain the child-soothing device on the child receptacle, wherein the retainer is attached to the child receptacle at a location within the soother receptacle pocket such that the child-soothing device is attached to and stored on the T-shaped junction member, and wherein the retainer includes a decouplable attachment adapted to permit the child-soothing device to be detached from the child-support device for cleaning, wherein the child-soothing device is attached to the T-shaped junction member of the harness assembly and stored in the soother receptacle of the junction member such that in a use position the child-soothing device is located for use by the child in the child receptacle with at least a substantial portion of the child-soothing device not received within the soother receptacle pocket, and in the stored position at least a substantial portion of the child-soothing device is stored in the soother receptacle pocket on the junction member when not in use by the child, wherein the child-soothing device is attached to and stored on the junction member in the stored position such that the child in the child receptacle can see and reach the child-soothing device and thereby such that the child in the child receptacle can grasp the child-soothing device in the stored position and move the child-soothing device to the use position.

12. The child-support device of claim 11, wherein the pocket is formed by a sheet of material attached to the front-facing surface of the junction member, the pocket includes an open top and a closed bottom and sides to provide for top insertion of the child-soothing device into the pocket.

13. The child-support device of claim 11, wherein the decouplable attachment includes mating hook-and-loop fasteners on the child-soothing device and the child-support device.

14. The child-support device of claim 11, wherein the child-support device is a bouncer that includes a frame adapted to rest on a supporting surface and that is coupled to and supports the child receptacle, and wherein the child-soothing device is a blanket.

* * * * *